US009701501B2

(12) United States Patent
Sumiyoshi

(10) Patent No.: US 9,701,501 B2
(45) Date of Patent: Jul. 11, 2017

(54) PAPER CONVEYING APPARATUS AND METHOD

(71) Applicant: FUJIFILM Corporation, Tokyo (JP)

(72) Inventor: Yuta Sumiyoshi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/083,318

(22) Filed: Mar. 29, 2016

(65) Prior Publication Data

US 2016/0289029 A1 Oct. 6, 2016

(30) Foreign Application Priority Data

Mar. 31, 2015 (JP) ..... 2015-071080

(51) Int. Cl.
*B65H 7/02* (2006.01)
*B65H 7/06* (2006.01)
(Continued)

(52) U.S. Cl.
CPC ..... *B65H 7/06* (2013.01); *B41F 23/08* (2013.01); *B41J 13/08* (2013.01); *B41J 13/223* (2013.01);
(Continued)

(58) Field of Classification Search
CPC ..... B65H 5/02; B65H 5/021; B65H 63/036; B65H 2301/44312; B65H 2301/44314; B65H 2301/44316; B65H 2301/4432; B65H 2301/44322; B65H 2301/44324; B65H 2404/25; B65H 2404/256; B65H 2513/40; B65H 2513/412; B65H 2513/512; B65H 2513/53; B65H 2557/652; B65H 2601/12; B65H 2601/121; B65H 2601/122
See application file for complete search history.

(56) References Cited

U.S. PATENT DOCUMENTS 5,597,154 A * 1/1997 Yamashita ..... B65H 9/006 271/10.03
6,029,971 A * 2/2000 Lynch ..... G07D 11/0003 221/13
(Continued)

FOREIGN PATENT DOCUMENTS

JP 2010-254458 A 11/2010

*Primary Examiner* — Prasad Gokhale
(74) *Attorney, Agent, or Firm* — Studebaker & Brackett PC

(57) ABSTRACT

A paper conveying apparatus includes: a driving device which rotates a driving rotating body by driving force; a conveying device which conveys a paper along a conveyance path according to rotation of a driven rotating body; an endless drive transmission belt which is stretched to the driving rotating body and the driven rotating body; a conveyance amount detecting device which detects a conveyance amount of the paper; an abnormality detecting device which detects abnormality of the paper; a stopping device which stops the driving device when the abnormality is detected; a calculating device which calculates the conveyance amount in time before conveyance stops after the abnormality is detected; a degradation detecting device which compares the calculated conveyance amount and a threshold and determines that the drive transmission belt is degraded if the calculated conveyance amount is larger than the threshold; and a reporting device which reports a determination result.

12 Claims, 8 Drawing Sheets

(51) Int. Cl.

| | |
|---|---|
| ***B65H 5/02*** | (2006.01) |
| ***B65H 63/036*** | (2006.01) |
| ***B65H 5/22*** | (2006.01) |
| ***B41F 23/08*** | (2006.01) |
| ***B41J 13/08*** | (2006.01) |
| ***B41J 13/22*** | (2006.01) |
| ***B41J 29/38*** | (2006.01) |

(52) U.S. Cl.

CPC ..... *B41J 29/38* (2013.01); *B65H 5/021* (2013.01); *B65H 5/224* (2013.01); *B65H 5/226* (2013.01); *B65H 63/036* (2013.01); *B65H 2403/20* (2013.01); *B65H 2511/22* (2013.01); *B65H 2511/30* (2013.01); *B65H 2511/417* (2013.01); *B65H 2513/512* (2013.01); *B65H 2553/51* (2013.01); *B65H 2601/12* (2013.01)

(56) References Cited

U.S. PATENT DOCUMENTS

2003/0173736 A1* 9/2003 Yano ..... B65H 5/06 271/264
2005/0195264 A1* 9/2005 Sootome ..... B41J 2/155 347/104
2009/0127776 A1* 5/2009 Dohki ..... B41J 11/007 271/262
2009/0195844 A1* 8/2009 Shiode ..... B41J 11/0095 358/498
2010/0276864 A1* 11/2010 Reuter ..... B65H 7/12 271/3.16
2011/0106489 A1* 5/2011 Satoh ..... B65H 7/02 702/151
2014/0327207 A1* 11/2014 Nakagaki ..... B65H 7/125 271/262

* cited by examiner

PAPER CONVEYING APPARATUS AND METHOD

CROSS-REFERENCE TO RELATED APPLICATIONS

The present application claims priority under 35 U.S.C. §119 to Japanese Patent Application No. 2015-071080, filed on Mar. 31, 2015. The above application is hereby expressly incorporated by reference, in its entirety, into the present application.

BACKGROUND OF THE INVENTION

Field of the Invention

The present invention relates to a paper conveying apparatus and a paper conveying method, and specifically relates to a paper conveyance technique that transmits the driving force of a driving device to a carrier by a drive transmission belt.

Description of the Related Art

An inkjet recording apparatus makes droplets of ink be deposited from an inkjet head to the recording surface of a paper which is conveyed through a predetermined conveyance path to record an image. This paper conveyance is performed by transmitting the driving force caused by a motor to a conveying cylinder which holds a paper in the peripheral surface or a roller to which a conveyance belt holding a paper in the surface is stretched, by a drive transmission belt.

However, since this drive transmission belt is generally configured with an elastic body such as rubber, there is a problem of causing deterioration over time.

Japanese Patent Application Laid-Open No. 2010-254458 describes a printer that displays the message to show that the belt is deteriorated when determining that the belt of driving transmission system of the second feed roller has deteriorated.

SUMMARY OF THE INVENTION

In an inkjet recording apparatus, when a paper to be conveyed floats from the conveyance surface of a conveying cylinder or conveyance belt which holds the paper, there are problems that: the distance from the droplet ejection surface of an inkjet head to the recording surface of the paper changes and the recording quality degrades; and the paper contacts with the droplet ejection surface of the head and the droplet ejection surface is damaged.

Therefore, if a paper float detecting apparatus is set up in a paper conveyance path and paper float equal to or greater than a specified value is detected, processing to stop paper conveyance is performed.

However, when a drive transmission belt degrades, there are problems that: it takes time until the paper conveyance stops after the paper float is caused, due to the occurrence of slip between the drive transmission belt and a pulley; and a floated paper collides with the inkjet head.

The present invention is made considering such circumstances, and the object of the invention is to provide a paper conveying apparatus and a paper conveying method which detect degradation of a drive transmission belt while detecting paper abnormality and prevent collision between a recording medium and an apparatus arranged in a conveyance path beforehand.

To achieve the above-mentioned object, one aspect of a paper conveying apparatus includes: a driving device which rotates a driving rotating body by generated driving force; a conveying device which conveys a paper along a conveyance path according to rotation of a driven rotating body; an endless drive transmission belt which is stretched to the driving rotating body and the driven rotating body; a conveyance amount detecting device which detects a conveyance amount of the paper by the conveying device; a processing device which is disposed in the conveyance path and applies processing to the paper; an abnormality detecting device which is disposed on an upstream side from the processing device in the conveyance path and detects abnormality of the paper; a stopping device which stops the driving device when the abnormality detecting device detects the abnormality; a calculating device which calculates the conveyance amount of the paper in time before conveyance of the paper by the conveying device stops after the abnormality is detected; a degradation detecting device which compares the calculated conveyance amount and a threshold and determines that the drive transmission belt is degraded if the calculated conveyance amount is larger than the threshold; and a reporting device which reports a determination result of the degradation detecting device.

According to this aspect, it is possible to detect the degradation of the drive transmission belt while detecting paper abnormality, and prevent collision between a recording medium and the processing device disposed in the conveyance path beforehand.

It is preferable that: the conveying device is a cylinder which holds the paper to a peripheral surface; and the driven rotating body is coupled with a shaft of the cylinder. By this means, it is possible to appropriately convey the paper along the conveyance path.

It is preferable that: the conveying device includes a conveyance belt which holds the paper to a surface; and the driven rotating body is a roller to which the conveyance belt is stretched. By this means, it is possible to appropriately convey the paper along the conveyance path.

It is preferable that the conveyance amount detecting device is a rotary encoder which outputs a pulse signal every unit rotation angle of the driven rotating body. By this means, it is possible to appropriately detect the conveyance amount of the paper by the conveying device.

It is preferable that: the threshold includes a first threshold and a second threshold smaller than a value of the first threshold; and the degradation detecting device determines degradation of the drive transmission belt in two stages. By this means, it is possible to appropriately determine the degradation of the drive transmission belt.

It is preferable that the reporting device reports that exchange of the drive transmission belts is necessary if the degradation detecting device determines that the calculated conveyance amount is larger than the first threshold, and the reporting device reports that adjustment of the drive transmission belts is necessary if the degradation detecting device determines that the calculated conveyance amount is equal to or smaller than the first threshold and larger than the second threshold. By this means, the user can know that the exchange of the drive transmission belt is necessary and the adjustment of the drive transmission belt is necessary.

It is preferable that the abnormality detecting device includes at least one of a float sensor, an overlap feed sensor and a jam sensor. By this means, it is possible to appropriately detect the abnormality of the paper.

It is preferable to further include a self-diagnosing device which operates the abnormality detecting device in a pseudo or compulsive manner. By this means, it is possible to perform self-diagnosis of the degradation of drive transmission belt.

It is preferable to further include an inactivating device which inactivates the calculating device and the degradation detecting device. By this means, if it is not necessary to determine the degradation of the drive transmission belt, it is possible to stop the determination operation of degradation.

It is preferable that the processing device includes at least one of a processing liquid applying device which applies a processing liquid to the paper, an image forming device which deposits droplets to the paper and forms an image, a reading device which reads the paper, a varnish applying device which applies varnish to the paper and a drying device which dries the paper. This aspect is applicable to a case where at least one of the processing liquid applying device, the image forming device, the reading device, the varnish applying device and the drying device is disposed in the conveyance path as a processing device.

To achieve the above-mentioned object, one aspect of a paper conveying method includes: a driving step of rotating a driving rotating body by driving force generated by a driving device; a transmitting step of transmitting the driving force from the driving rotating body to a driven rotating body by an endless drive transmission belt stretched to the driving rotating body and the driven rotating body of a conveying device; a conveying step of conveying a paper along a conveyance path of the conveying device according to rotation of the driven rotating body; a conveyance amount detecting step of detecting a conveyance amount of the paper in the conveying step; a processing step of applying processing to the paper by a processing device disposed in the conveyance path; an abnormality detecting step of detecting abnormality of the paper by an abnormality detecting device disposed on an upstream side from the processing device in the conveyance path; a stopping step of stopping the driving device when the abnormality is detected in the abnormality detecting step; a calculating step of calculating the conveyance amount of the paper in time before conveyance of the paper in the conveying step stops after the abnormality is detected; a degradation detecting step of comparing the calculated conveyance amount and a threshold and determining that the drive transmission belt is degraded if the calculated conveyance amount is larger than the threshold; and a reporting step of reporting a determination result of the degradation detecting step.

According to this aspect, it is possible to detect the degradation of the drive transmission belt while detecting paper abnormality, and prevent collision between a recording medium and the processing device disposed in the conveyance path beforehand.

To achieve the above-mentioned object, one aspect of a program which causes a computer to execute steps of a paper conveying method includes: a driving step of rotating a driving rotating body by driving force generated by a driving device; a transmitting step of transmitting the driving force from the driving rotating body to a driven rotating body by an endless drive transmission belt stretched to the driving rotating body and the driven rotating body of a conveying device; a conveying step of conveying a paper along a conveyance path of the conveying device according to rotation of the driven rotating body; a conveyance amount detecting step of detecting a conveyance amount of the paper in the conveying step; a processing step of applying processing to the paper by a processing device disposed in the conveyance path; an abnormality detecting step of detecting abnormality of the paper by an abnormality detecting device disposed on an upstream side from the processing device in the conveyance path; a stopping step of stopping the driving device when the abnormality is detected in the abnormality detecting step; a calculating step of calculating the conveyance amount of the paper in time before conveyance of the paper in the conveying step stops after the abnormality is detected; a degradation detecting step of comparing the calculated conveyance amount and a threshold and determining that the drive transmission belt is degraded if the calculated conveyance amount is larger than the threshold; and a reporting step of reporting a determination result of the degradation detecting step.

A non-transitory tangible computer-readable recording medium including a program stored thereon, such that when the program is read and executed by a computer, the computer is configured to perform: a driving step of rotating a driving rotating body by driving force generated by a driving device; a transmitting step of transmitting the driving force from the driving rotating body to a driven rotating body by an endless drive transmission belt stretched to the driving rotating body and the driven rotating body of a conveying device; a conveying step of conveying a paper along a conveyance path of the conveying device according to rotation of the driven rotating body; a conveyance amount detecting step of detecting a conveyance amount of the paper in the conveying step; a processing step of applying processing to the paper by a processing device disposed in the conveyance path; an abnormality detecting step of detecting abnormality of the paper by an abnormality detecting device disposed on an upstream side from the processing device in the conveyance path; a stopping step of stopping the driving device when the abnormality is detected in the abnormality detecting step; a calculating step of calculating the conveyance amount of the paper in time before conveyance of the paper in the conveying step stops after the abnormality is detected; a degradation detecting step of comparing the calculated conveyance amount and a threshold and determining that the drive transmission belt is degraded if the calculated conveyance amount is larger than the threshold; and a reporting step of reporting a determination result of the degradation detecting step. By this means, it is possible to detect the degradation of a drive transmission belt and prevent collision between a recording medium and an apparatus arranged in a conveyance path beforehand.

According to the present invention, it is possible to detect the degradation of a drive transmission belt while detecting paper abnormality and prevent collision between a recording medium and an apparatus arranged in a conveyance path beforehand.

DETAILED DESCRIPTION OF THE EMBODIMENTS

In the following, embodiments of the present invention are described according to the accompanying drawings.

Outline of Inkjet Recording Apparatus: First Embodiment

Figure 1:
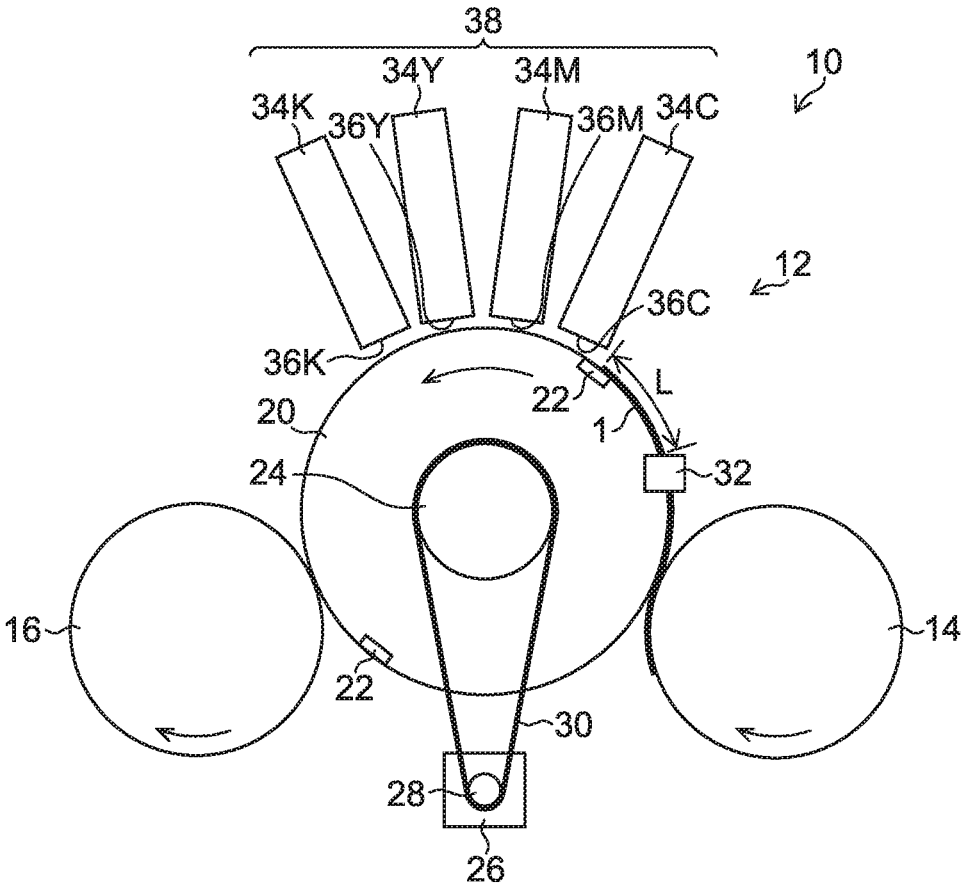
FIG. 1 is a schematic side view illustrating an inkjet recording apparatus 10.

An inkjet recording apparatus according to the present embodiment determines degradation of a drive transmission belt and informs the degradation to a user. As illustrated in FIG. 1, the inkjet recording apparatus 10 is a line printer of a single-pass system to form an image on a recording surface of a paper 1, and includes a conveying portion 12 and a recording portion 38.

The conveying portion 12 (one example of a paper conveying apparatus) includes an upstream transfer cylinder 14, a downstream transfer cylinder 16 and a jetting cylinder 20.

The paper 1 conveyed by the upstream transfer cylinder 14 is transferred to the jetting cylinder 20 (one example of a conveying apparatus and one example of a rotating body) and conveyed by the jetting cylinder 20. The recording portion 38 (one example of an image forming device) deposits ink in the paper 1 conveyed by the jetting cylinder 20 and forms an image on the recording surface of the paper 1. The paper 1 on which the image is formed is transferred from the jetting cylinder 20 to the downstream transfer cylinder 16.

Two grippers 22 to grip the front end of the paper 1 are provided in positions opposed across the rotating shaft of the conveyance surface of the jetting cylinder 20. Moreover, a lot of suction holes (not illustrated) are formed on the conveyance surface of the jetting cylinder 20 in a predetermined pattern.

The jetting cylinder 20 supports a rotating shaft 24 (one example of a driven rotating body) to a shaft bearing (not illustrated) in a rotatable manner. For example, a motor 26 (one example of a driving device) is a stepping motor, and a rotating shaft 28 that is a driving rotating body extends. When the motor 26 drives, the rotating shaft 28 rotates by the driving force thereof. An endless belt 30 (one example of a drive transmission belt) is stretched to the rotating shaft 24 of the jetting cylinder 20 and the rotating shaft 28 of the motor 26. By this means, the driving force (rotating force) of the motor 26 is transmitted to the rotating shaft 24 through the rotating shaft 28 and the belt 30, and the jetting cylinder 20 counterclockwise rotates in FIG. 1 according to the rotation of the rotating shaft 24.

As for the paper 1 transferred from the upstream transfer cylinder 14, the front end thereof is gripped by the gripper 22, and it is wound around a conveyance surface that is the paper holding surface of the jetting cylinder 20 to be rotated. In addition, by being sucked from a suction hole, the paper 1 is sucked and held to the conveyance surface of the jetting cylinder 20. The jetting cylinder 20 conveys the sucked and held paper 1 in a paper conveyance direction that is the rotation direction of the jetting cylinder 20.

The paper detecting sensor 32 is provided, as an abnormality detecting device, on the upstream side of the recording portion 38 of a conveyance path of the paper 1 in the jetting cylinder 20. The paper detecting sensor 32 is a paper float sensor which detects a bulge due to float of the paper 1 or a crease of the paper 1 on a conveyance surface, and, for example, is configured so as to detect the float of the paper 1 according to a shading way by irradiating light from one end in the width direction of the conveyance surface of the jetting cylinder 20 and receiving light in the other end or receiving reflected light from a reflective surface arranged in the other end.

Here, the paper detecting sensor 32 only has to be able to detect abnormality in the conveyance of the paper 1, and an overlap feed sensor which detects the overlap feed to convey a plurality of papers 1 and a jam sensor which detects paper jam in a conveyance path, and so on, may be used.

The recording portion 38 (one example of a processing device) includes four inkjet heads 34C, 34M, 34Y and 34K. Four inkjet heads 34C, 34M, 34Y and 34K (which are one example of a liquid ejection head) are sequentially disposed from the upstream side at predetermined intervals in the paper conveyance direction of the jetting cylinder 20. The inkjet heads 34C, 34M, 34Y and 34K respectively include nozzle surfaces 36C, 36M, 36Y and 36K which are opposed to the jetting cylinder 20, and a plurality of nozzles (not illustrated) to respectively eject cyanogen, magenta, yellow and black ink are formed over the entire width of the paper 1 in respective nozzle surfaces 36C, 36M, 36Y and 36K.

Respective inkjet heads 34C, 34M, 34Y and 34K are held such that respective nozzle surfaces 36C, 36M, 36Y and 36K are parallel to the direction of a tangent in a position opposed to respective nozzle surfaces 36C, 36M, 36Y and 36K of the conveyance surface of the jetting cylinder 20.

A control portion (not illustrated) which generalizes the record control of the inkjet recording apparatus 10 controls the inkjet heads 34C, 34M, 34Y and 34K, and makes droplets of ink be ejected from each nozzle. By this means, an image is formed on the recording surface of the paper 1 conveyed by the jetting cylinder 20.

In addition, the paper 1 in which the image is formed on the recording surface is conveyed by the jetting cylinder 20 and transferred to the downstream transfer cylinder 16.

Thus, the inkjet recording apparatus 10 can form an image on the whole surface of the recording surface of the paper 1 by one conveyance (single pass) by the conveying portion 12.

<System Configuration of Conveying Portion>

Figure 2:
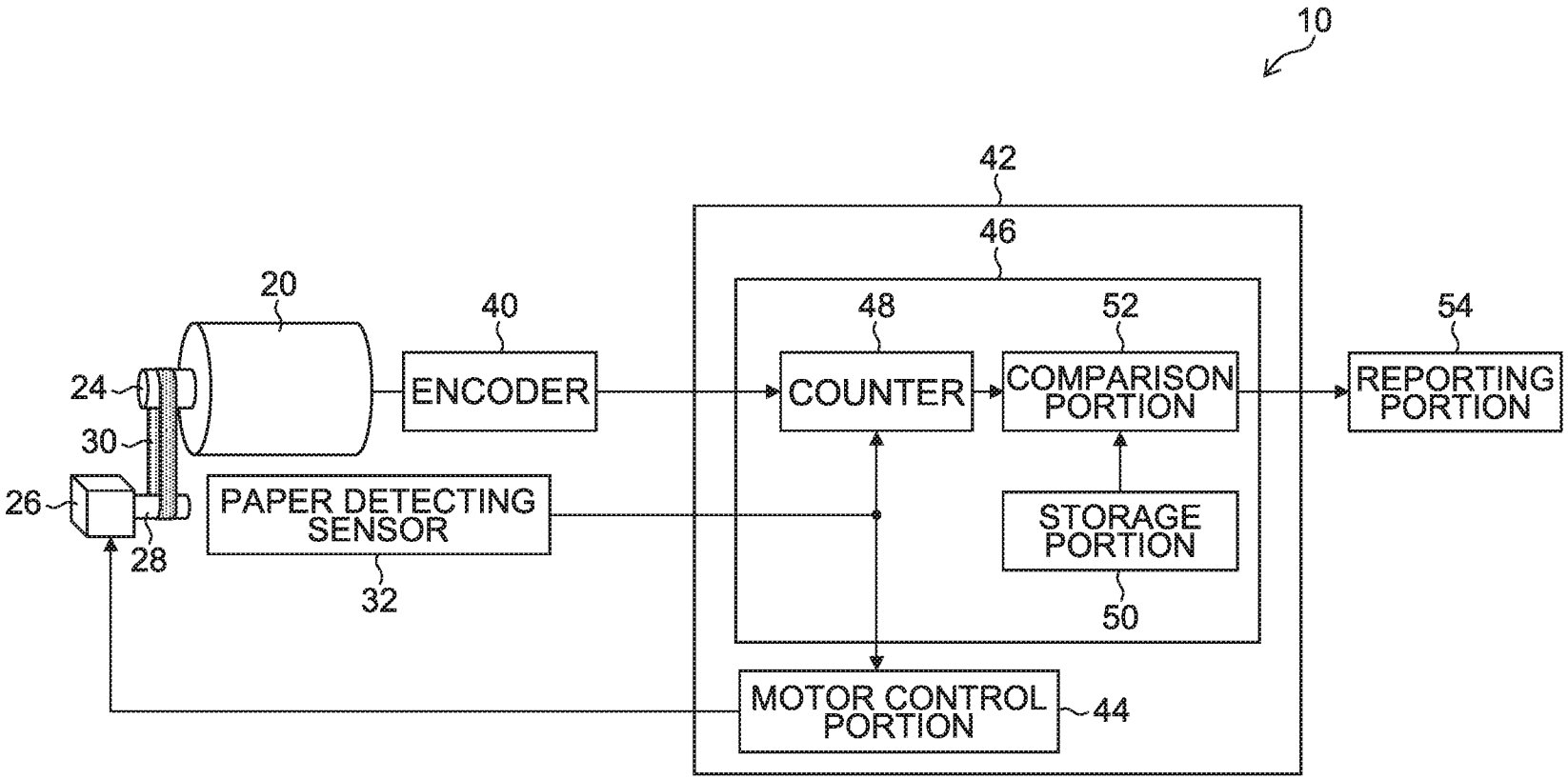
FIG. 2 is a block diagram illustrating a system configuration of a conveying portion 12.

As illustrated in FIG. 2, the conveying portion 12 includes the encoder 40, a conveyance control portion 42 and a reporting portion 54 in addition to the above-mentioned jetting cylinder 20, the rotating shaft 24, the motor 26, the rotating shaft 28, the belt 30 and the paper detecting sensor 32.

The encoder 40 (one example of a conveyance amount detecting device) is provided in the jetting cylinder 20 and outputs a signal corresponding to the conveyance amount of the paper 1 by the jetting cylinder 20. Here, a rotary encoder which outputs a pulse signal for each unit rotation angle of the rotating shaft 24 is used.

The conveyance control portion 42 includes a motor control portion 44 and an operation portion 46.

The motor control portion 44 (one example of a stopping device) starts the drive of the motor 26 and conveys the paper 1 by the conveying portion 12. Moreover, when a paper abnormality signal by the paper detecting sensor 32 is input, the drive of the motor 26 is stopped.

The operation portion 46 includes a PLD (Programmable Logic Device) or a CPU (Central Processing Unit), and includes a counter 48, a storage portion 50 and a comparison portion 52. The counter 48 (one example of a calculating device) counts a number of pulse signals input from the encoder 40 after a paper abnormality signal by the paper detecting sensor 32 is input. The storage portion 50 stores a threshold which is compared with the count result of the counter 48 and indicates the degradation of the belt 30. The comparison portion 52 (one example of a degradation detecting device) compares the count result of the counter 48 and the threshold stored in the storage portion 50. As a result, if the count result of the counter 48 is larger than the threshold, it is determined that the belt 30 is degraded.

The reporting portion 54 is a reporting device which reports the determination result of the comparison portion 52 to the user, and a display apparatus and an alarm apparatus can be used.

<Paper Conveying Method of Conveying Portion>

Figure 3:
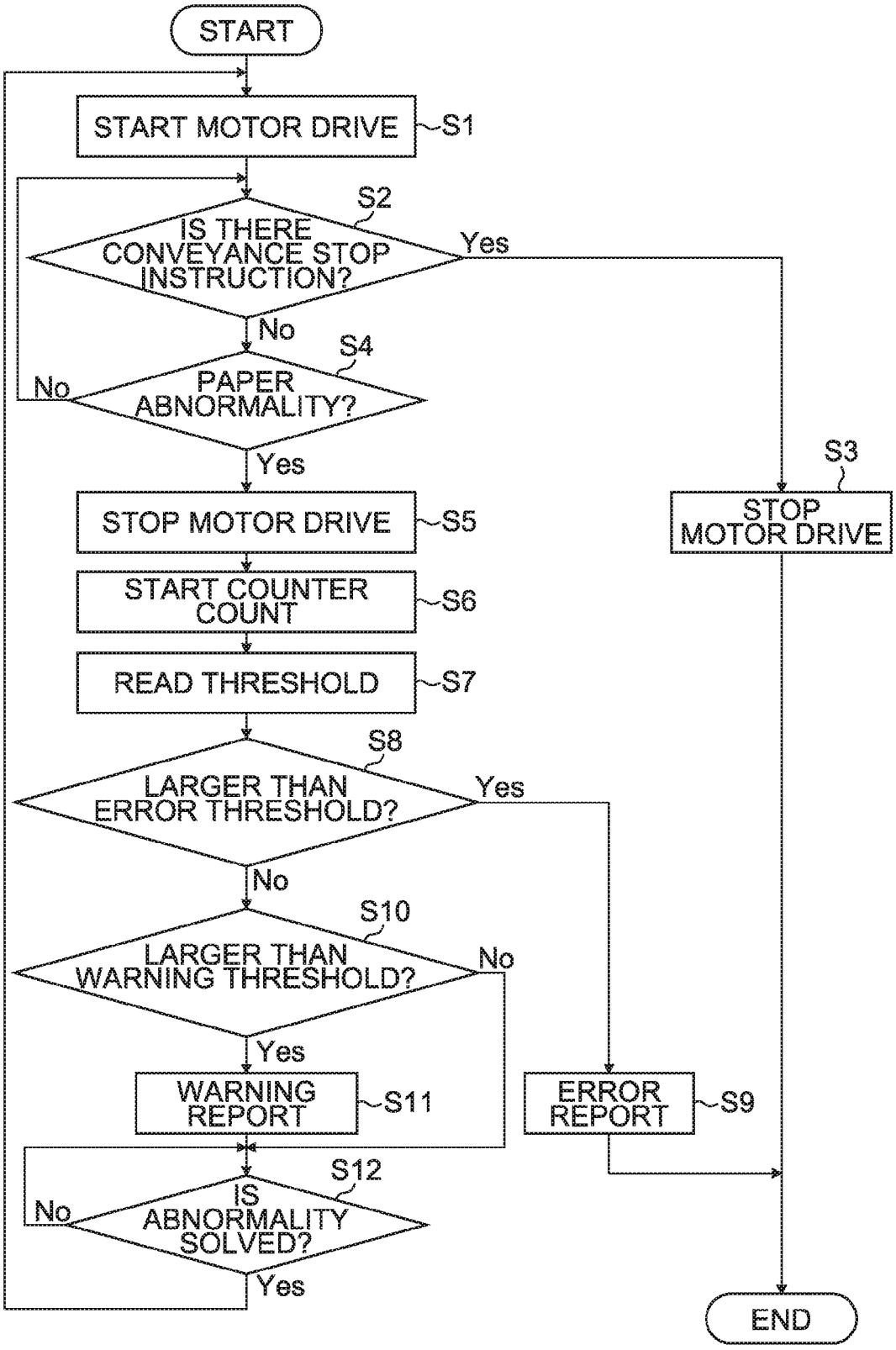
FIG. 3 is a flowchart illustrating an operation of the conveying portion 12.

Next, the paper conveying method of the conveying portion 12 is described using the flowchart of FIG. 3.

When there is a conveyance start instruction by the user from an inputting device (not illustrated), the motor control portion 44 starts the drive of the motor 26 (step S1). When the motor 26 drives, the rotating shaft 28 rotates (one example of a driving step). The driving force of this rotating shaft 28 is transmitted to the rotating shaft 24 of the jetting cylinder 20 through the belt 30 (one example of a transmitting step). The jetting cylinder 20 rotates according to the rotation of the rotating shaft 24. By this means, the paper 1 is conveyed along a conveyance path by the upstream transfer cylinder 14, the jetting cylinder 20 and the downstream transfer cylinder 16 (one example of a conveying step). Moreover, an image is recorded on this paper 1 by the recording portion 38 (one example of a processing step).

Next, the presence of a conveyance stop instruction from the inputting device is determined (step S2). If there is the conveyance stop instruction, the motor control portion 44 stops the drive of the motor 26 and ends the conveyance of the paper 1 by the conveying portion 12 (step S3).

If there is no conveyance stop instruction, the presence of occurrence of paper abnormality is determined (step S4: one example of an abnormality detecting step). The occurrence of paper abnormality is determined on the basis of the output result of the paper detecting sensor 32. If the paper abnormality does not occur, it returns to step S2 and similar processing is repeated.

If the paper abnormality occurs, the motor control portion 44 stops the drive of the motor 26 and stops the conveyance of the paper 1 (step S5: one example of a stopping step). Moreover, the counter 48 counts the number of pulse signals in time before the pulse signal output of the encoder 40 stops after paper abnormality occurs (step S6: one example of a conveyance amount detecting step and one example of a calculating step).

Originally, if the drive of the motor 26 stops, it is preferable that the jetting cylinder 20 immediately stops too. However, it takes time to stop the rotation of the jetting cylinder 20 by inertia. By this means, overrun occurs in the paper 1 in which abnormality occurs.

Figure 4:
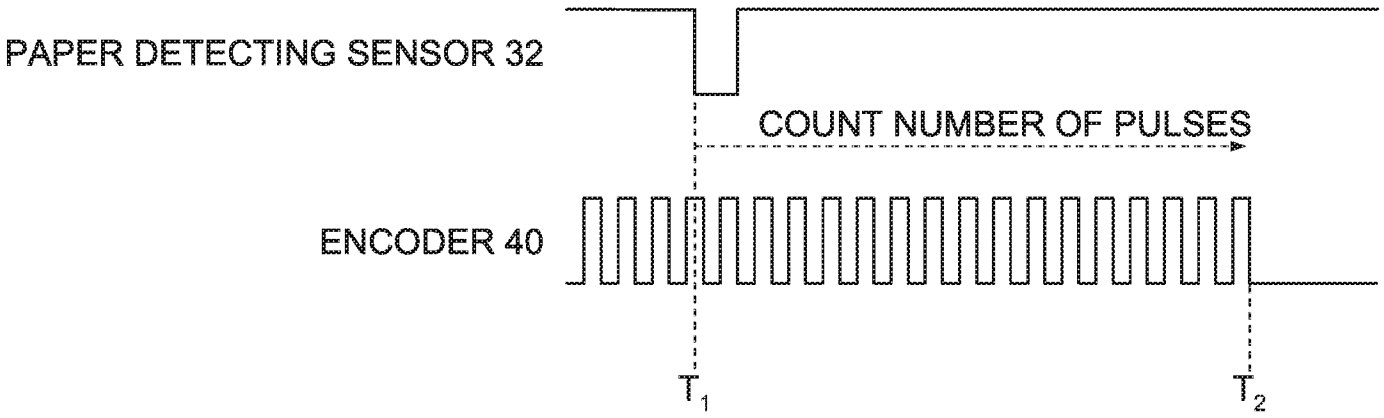
FIG. 4 is a diagram illustrating one example of an output signal of a paper detecting sensor 32 and an output signal of an encoder 40.

Paper abnormality occurs in time $T_1$ in the example illustrated in FIG. 4, but it is time $T_2$ when the rotation of the jetting cylinder 20 actually stops. Therefore, here, pulse signals of the encoder 40 by time $T_2$ at which the pulse signal of the encoder 40 stops after time $T_1$ at which the paper detecting sensor 32 outputs an abnormal signal is counted. By converting this pulse number, the conveyance distance of the paper 1 in time before the rotation of the jetting cylinder 20 stops after paper abnormality occurs is understood. This conveyance distance can be treated as a braking distance after the paper abnormality occurs.

Here, this braking distance may be guessed by measuring time between time $T_1$ and time $T_2$.

According to the degradation of the belt 30, the slip between the belt 30 and the rotating shaft 24 or the rotating shaft 28 is caused and the belt 30 is expanded, and therefore this braking distance increases.

In the present embodiment, it is assumed that peripheral length L in the conveyance surface of the jetting cylinder 20 from the paper detecting sensor 32 to the inkjet head 34C is 300 mm (see FIG. 1). Moreover, it is assumed that the pitch of the peripheral length in the conveyance surface of the jetting cylinder 20 with respect to one pulse of the encoder 40 is 0.3 mm. In this case, when the braking distance of the jetting cylinder 20 after the paper detecting sensor 32 detects abnormality exceeds a peripheral length for 1000 pulses of an output pulse of the encoder 40, it is understood that the paper 1 collides with the inkjet head 34C.

Next, the comparison portion 52 reads an error threshold and a warning threshold from the storage portion 50 (step S7). Here, in the storage portion 50, 900 is assumed to be set and stored beforehand as an error threshold (one example of a first threshold), and 700 is assumed to be set and stored beforehand as a warning threshold (one example of a second threshold smaller than the value of the first threshold).

When the jetting cylinder 20 completely stops, the comparison portion 52 compares the number of pulse signals of the encoder 40 counted by the counter 48 and the error threshold read from the storage portion 50, and determines whether the number of pulse signals is larger than the error threshold (step S8: one example of a degradation detecting step).

If the error threshold is larger, it proceeds to step S9 to cause the reporting portion 54 to perform error report (step S9: one example of a reporting step), and the conveyance operation ends. As the error report, the one to instruct the exchange of belts 30 (one example in which exchange is necessary) can be used.

If the number of pulse signals is equal to or smaller than the error threshold, the comparison portion 52 compares the number of pulse signals of the encoder 40 counted by the counter 48 and the warning threshold read from the storage portion 50, and determines whether the number of pulse signals is (equal to or smaller than the error threshold and) larger than the warning threshold (step S10: one example of a degradation detecting step).

Here, if the warning threshold is larger, the reporting portion 54 is caused to perform warning report (step S11: one example of a reporting step). As the warning report, the one to instruct tension adjustment of the belt 30 (one example in which belt adjustment is necessary) and encourage the arrangement of the belt 30 for exchange can be used. By this means, the user performs the tension adjustment of the belt 30 and arranges the belt 30 for exchange.

If the number of pulse signals is equal to or smaller than the warning threshold in step S10 or the warning report is performed in step S11, next, it is determined whether the abnormality of the paper 1 is overcome (step S12). If the abnormality is overcome by the removal of the paper 1 detected by the paper detecting sensor 32, and so on, it returns to step S1 and similar processing is repeated.

Thus, in the present embodiment, it is possible to detect the degradation of a belt for the transmission of motor driving force on the basis of a braking distance after the occurrence of paper abnormality while detecting the paper abnormality, and notice the paper abnormality and the belt degradation to the user simultaneously.

Specifically, if the braking distance exceeds the threshold set in the storage portion, belt warning or error is reported and belt adjustment or exchange is instructed. Therefore, if abnormality occurs in a conveyed paper, it is possible to prevent this paper from colliding with an inkjet head due to the degradation of the belt beforehand and protect the inkjet head. Moreover, since it is designed such that the degree of degradation is treated in two stages of warning and error and reporting is performed in these two stages, it is possible to prevent an apparatus from becoming unavailable suddenly.

It is also possible to understand the above-described belt degradation determining method as a program which causes a computer to execute each step or a non-transitory tangible computer-readable recording medium for storing the program.

System Configuration of Conveying Portion: Second Embodiment

Figure 5:
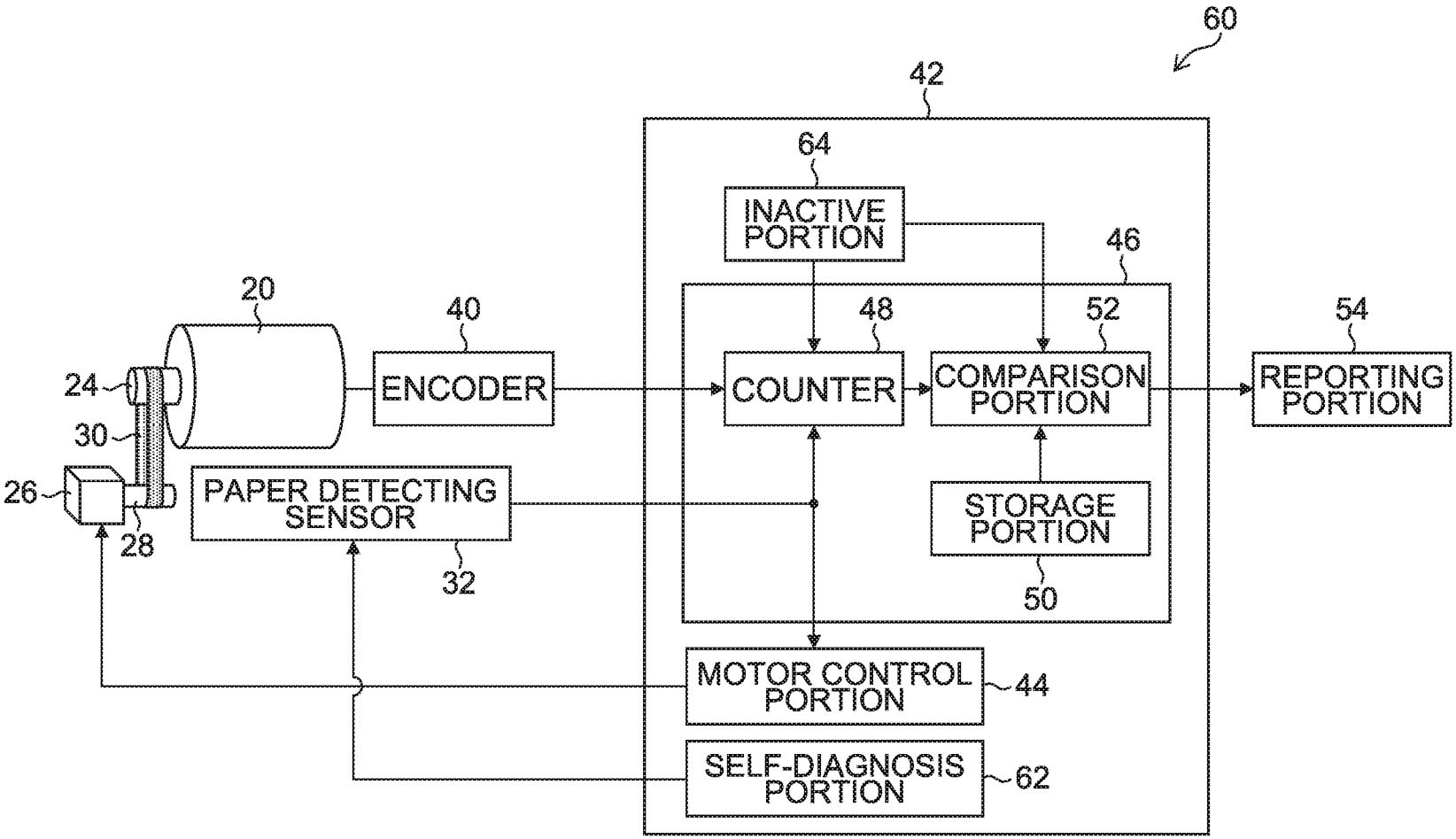
FIG. 5 is a block diagram illustrating a system configuration of a conveying portion 60.

Next, a conveying portion according to the second embodiment is described using FIG. 5. Here, the same reference numerals are assigned to portions common with FIG. 2, and detailed explanation thereof is omitted.

As illustrated in FIG. 5, the conveying portion 60 includes a self-diagnosis portion 62 and an inactive portion 64.

The self-diagnosis portion 62 (one example of a self-diagnosing device) operates the paper detecting sensor 32 in a pseudo or compulsive manner to perform self-diagnosis of the degradation of the belt 30. Here, if the self-diagnosis portion 62 is set to a self-diagnosis mode of the belt 30 by the user from an inputting device (not illustrated), an abnormality detection signal of the paper detecting sensor 32 is compulsorily generated. The motor control portion 44, the counter 48, the storage portion 50, the comparison portion 52 and the reporting portion 54 operate according to this signal, and it is possible to determine the degradation of the belt 30.

The self-diagnosis portion 62 may be assumed as a signal generating device which generates an abnormality detection signal of the paper detecting sensor 32 in a pseudo manner. Moreover, the self-diagnosis portion 62 may periodically perform self-diagnosis of the degradation of the belt 30. For example, at the time of stopping the conveyance of the paper 1 by the conveying portion 60 when the operation of the inkjet recording apparatus 10 ends, it may perform self-diagnosis of the degradation of the belt 30. Moreover, the reporting portion 54 at the time of this self-diagnosis may perform not only warning report and error report but also report the number of pulses counted in the counter 48. Here, at the time of the self-diagnosis, the paper 1 need not be actually conveyed.

Moreover, the inactive portion 64 (one example of an inactivating device) inactivates the operation of the counter 48 and the comparison portion 52. For example, if a self-diagnosis mode of the paper detecting sensor 32 is set by the user from an inputting device (not illustrated), there is a case where the paper detecting sensor 32 generates an abnormality detection signal. It is useless and troublesome that the counter 48 and the comparison portion 52 operate in each case. Therefore, if it is not necessary to determine the degradation of the belt 30 of the self-diagnosis mode or the like of the paper detecting sensor 32, the inactive portion 64 inactivates the operation of the counter 48 and the comparison portion 52. They may be activated only when the paper 1 is normally conveyed and when it is in a self-diagnosis mode of the degradation of the belt 30.

Configuration of Inkjet Recording Apparatus: Third Embodiment

Figure 6:
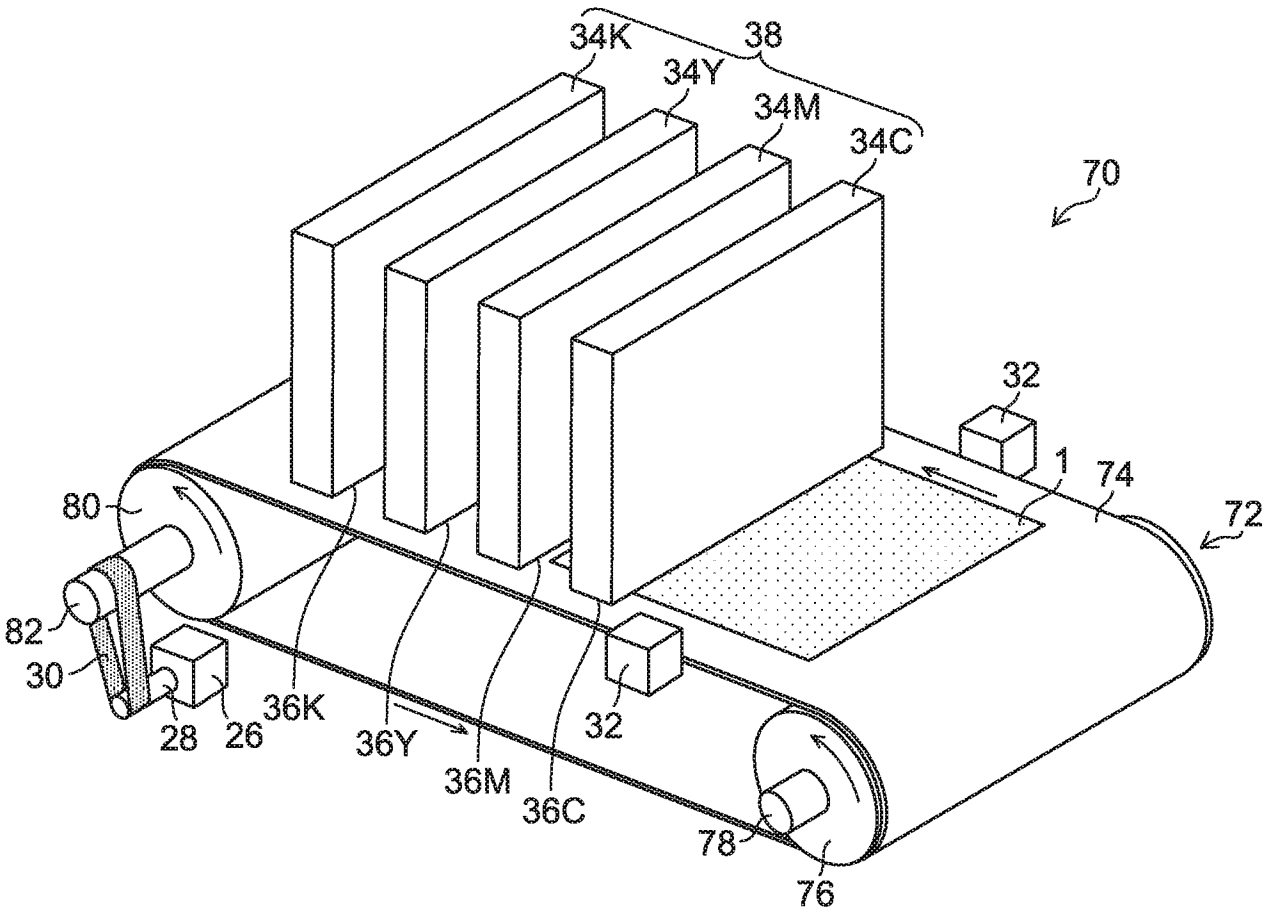
FIG. 6 is a schematic side view illustrating an inkjet recording apparatus 70.

Next, an inkjet recording apparatus according to the third embodiment is described using FIG. 6. Here, the same reference numerals are assigned to portions common with FIG. 1 and detailed explanation thereof is omitted.

As illustrated in FIG. 6, the inkjet recording apparatus 70 is a single-pass line printer of a single-pass system to form an image on the recording surface of the paper 1, and includes a conveying portion 72 and the recording portion 38.

The conveying portion 72 is a conveying device of a belt conveyance system to suck and hold the paper 1 that is a recording medium on a conveyance belt 74 and convey the paper 1. The conveyance belt 74 is an endless belt having a width larger than the width of the conveyed paper 1, and is wound around an upstream roller 76 and a downstream roller 80.

The upstream roller 76 and the downstream roller 80 (one example of a rotating body) are supported to a shaft bearing (not illustrated) so as to freely rotate a rotating shaft 78 and a rotating shaft 82 (one example of a driven rotating body) respectively.

The conveying portion 72 has the motor 26 as a driving device. The endless belt 30 is stretched to the rotating shaft 82 of the downstream roller 80 and the rotating shaft 28 of the motor 26.

When the motor 26 drives, the rotating shaft 28 rotates by the driving force thereof. This rotation is transmitted to the downstream roller 80 through the belt 30, and the downstream roller 80 rotates counterclockwise in the figure. The conveyance belt 74 runs by the rotation of this downstream roller 80. By this means, the paper 1 placed on the conveyance belt 74 is conveyed along a conveyance path.

Moreover, a lot of suction holes (not illustrated) are provided in the conveyance belt 74, and a suction pump (not illustrated) is provided on the lower side of the conveyance belt 74 (which is a side opposite to a surface on which the paper 1 is placed). The conveying portion 72 sucks and holds the paper 1 on the conveyance belt 74 by sucking the paper 1 placed on the conveyance belt 74 by this suction pump through the suction holes.

The paper detecting sensor 32 is provided on the upstream side of the recording portion 38 of the conveyance path of the paper 1 in the conveyance belt 74.

The recording portion 38 includes four inkjet heads 34C, 34M, 34Y and 34K. Four inkjet heads 34C, 34M, 34Y and 34K are sequentially disposed from the upstream side at predetermined intervals in the paper conveyance direction of the jetting cylinder 20. In the inkjet heads 34C, 34M, 34Y and 34K, a plurality of nozzles provided in respective nozzle surfaces 36C, 36M, 36Y and 36K are formed over the entire width of the paper 1.

A control portion (not illustrated) which manages the record control of the inkjet recording apparatus 70 controls the inkjet heads 34C, 34M, 34Y and 34K, and causes ink to be ejected from each nozzle. By this means, an image is formed on the recording surface of the paper 1 conveyed by the conveyance belt 74.

The system configuration in the conveying portion 72 configured in this way is similar to the system configuration of the conveying portion 12 illustrated in FIGS. 2 and 5. Therefore, by detecting the degradation of the belt 30 and reporting it to the user, collision with the inkjet heads 34C, 34M, 34Y and 34K placed in the conveyance path of the paper 1 can be prevented beforehand.

Configuration of Varnish Applying Apparatus: Fourth Embodiment

Figure 7:
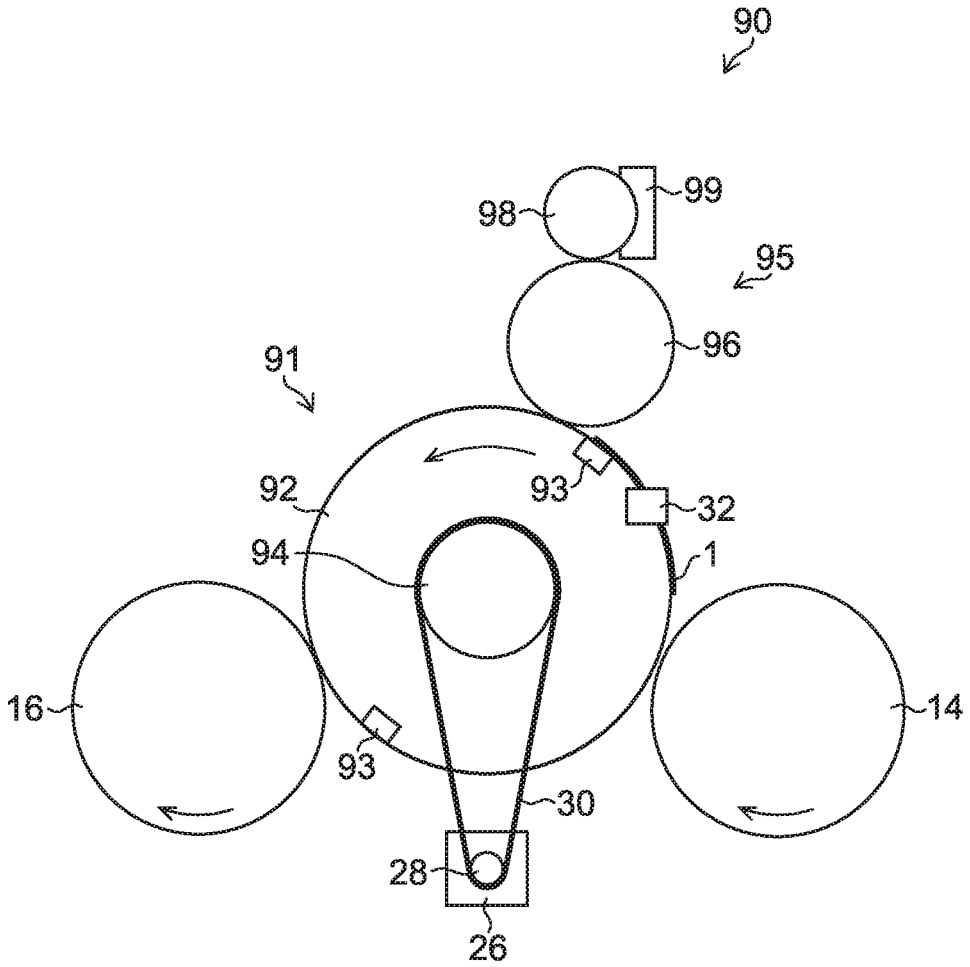
FIG. 7 is a schematic side view illustrating a varnish applying apparatus 90.

Next, a varnish applying apparatus according to the fourth embodiment is described using FIG. 7. Here, the same reference numerals are assigned to portions common with FIG. 1, and detailed explanation thereof is omitted.

The varnish applying apparatus 90 is an apparatus which applies a varnish liquid (coating liquid) to the recording surface of the paper 1 on which an image is recorded, and includes a conveying portion 91 and a varnish liquid applying portion 95.

The conveying portion 91 includes the upstream transfer cylinder 14, the downstream transfer cylinder 16 and a varnish impression cylinder 92.

The varnish impression cylinder 92 (one example of a rotating body) is a cylindrical drum which receives the paper 1 conveyed by the upstream transfer cylinder 14, holds the received paper 1 to the outer peripheral surface and performs rotation conveyance, and transfers it to the downstream transfer cylinder 16. In the varnish impression cylinder 92, two grippers 93 to grip the front end of the paper 1 are provided. The varnish impression cylinder 92 is fixed to a rotating shaft 94 (one example of a driven rotating body) and supported so as to be rotatable around the rotating shaft 94.

In the varnish impression cylinder 92, the endless belt 30 is stretched to the rotating shaft 94 and the rotating shaft 28 of the motor 26 in the same way as the jetting cylinder 20 illustrated in FIG. 1, and the driving force of the motor 26 is transmitted to the varnish impression cylinder 92 through the belt 30. By this means, the varnish impression cylinder rotates counterclockwise in the figure, holds the paper 1 gripped by the gripper 93 to the outer peripheral surface and conveys it.

The paper detecting sensor 32 is set up on the upstream side of the varnish liquid applying portion 95 in the conveyance path of the paper 1 with the varnish impression cylinder 92.

Meanwhile, the varnish liquid applying portion 95 includes a varnish cylinder 96, a varnish supply roller 98 and a varnish chamber 99.

The varnish cylinder 96 (one example of a varnish applying device) is a varnish application roller which performs transcription application (coating) of a varnish liquid held on the surface to the recording surface of the paper 1, and a varnish plate (which is not illustrated and is a resin plate or a blanket) is wound around the outer peripheral surface. The varnish supply roller 98 is a measurement roller which supplies a varnish liquid of a constant amount to the varnish plate surface of the varnish cylinder 96. The varnish chamber 99 stores a varnish liquid, and, by dipping part of the varnish supply roller 98 in this varnish liquid, supplies the varnish liquid to the varnish supply roller 98. The supply of the varnish liquid to the varnish chamber 99 is performed by a varnish liquid circulation apparatus (not illustrated).

The kind of a varnish to be used is not especially limited, and, for example, it is possible to use an aqueous varnish and an ultraviolet curing varnish (UV varnish), and so on.

In the varnish applying apparatus 90 configured as above, a varnish liquid is supplied from the varnish chamber 99 to the varnish supply roller 98. As for the varnish liquid supplied from the varnish chamber 99, the varnish liquid is measured by a constant amount and uniformly supplied to the varnish supply roller 98 by scraping an extra varnish liquid from the surface of the varnish supply roller 98 by a chamber blade (not illustrated). Subsequently, the measured varnish liquid is uniformly transcribed from the varnish supply roller 98 to a varnish plate (not illustrated) of the varnish cylinder 96.

Meanwhile, the paper 1 transferred from the upstream transfer cylinder 14 to the varnish impression cylinder 92 is held to the outer peripheral surface of the varnish impression cylinder 92, is conveyed by the rotation of the varnish impression cylinder 92 and arrives at the contact point (nip point) between the varnish impression cylinder 92 and the varnish cylinder 96.

As for a varnish liquid that is uniformly applied to the varnish plate of the varnish cylinder 96 and held, when the varnish plate and the paper 1 conveyed by the varnish impression cylinder 92 contact to each other in the nip point, the varnish liquid is subjected to uniform transcription application on the recording surface of the paper 1. Thus, when the varnish liquid is uniformly transcribed to the recording surface of the paper 1, the drying fixation of the varnish liquid in a varnish drying fixing portion (not illustrated) becomes stable.

After the varnish liquid is subjected to uniform transcription application on the recording surface of the paper 1 by the varnish cylinder 96, the varnish impression cylinder 92 transfers the paper 1 to the downstream transfer cylinder 16.

Moreover, when the paper detecting sensor 32 detects the float and bulge of the paper 1 wound around the peripheral surface of the varnish impression cylinder 92, the motor 26 that drives the varnish impression cylinder 92 is stopped. At this time, in the same way as the first embodiment, the degradation of the belt 30 is detected, and, if it is degraded, it is reported to the user. By this means, the paper 1 in which abnormality occurs by the degradation of the belt 30 can be prevented from colliding with the varnish cylinder 96 beforehand.

Configuration of Inkjet Recording Apparatus: Fifth Embodiment

Figure 8:
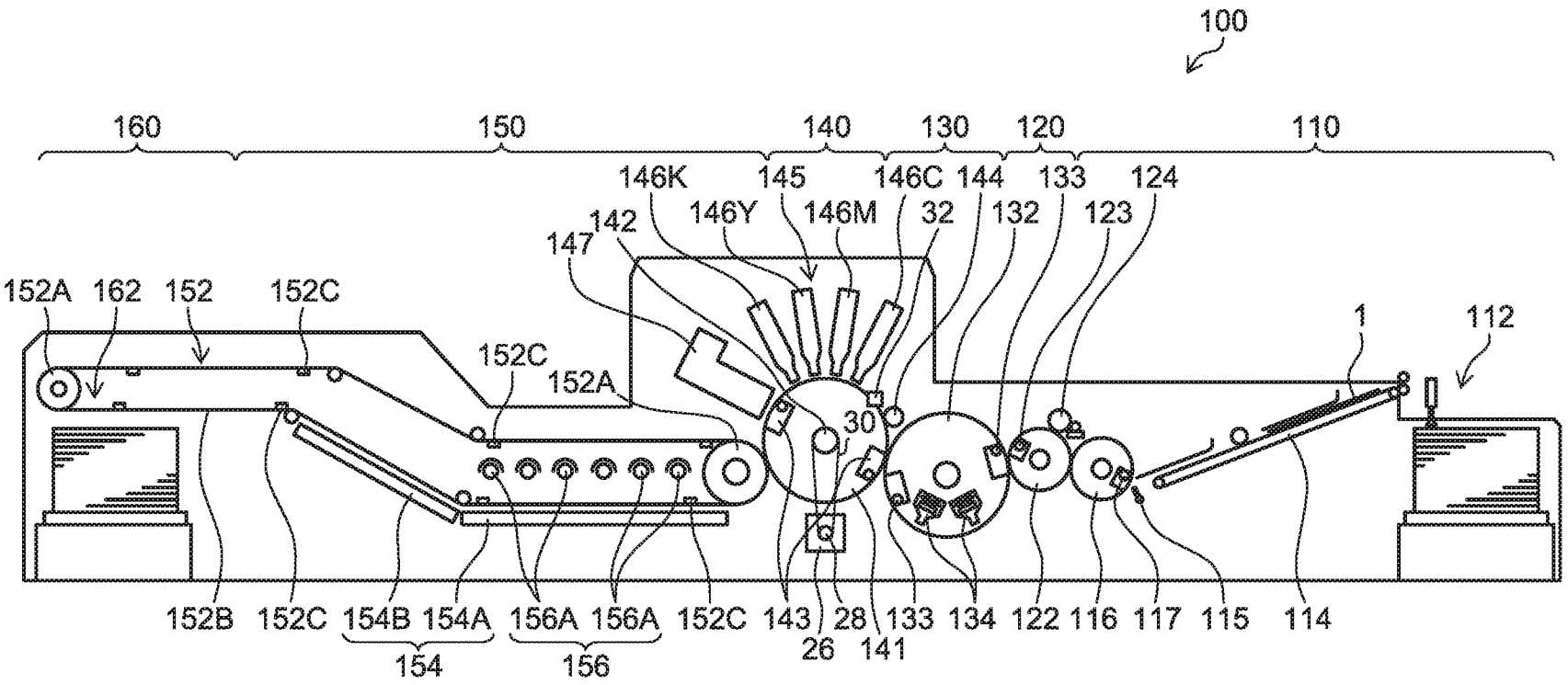
FIG. 8 is a schematic side view illustrating the inkjet recording apparatus 100.

Next, an inkjet recording apparatus according to the fifth embodiment is described using FIG. 8. Here, the same reference numerals are assigned to portions common with FIG. 1, and detailed explanation thereof is omitted.

<Entire Configuration of Image Recording Apparatus>

The inkjet recording apparatus 100 is a sheet-type color inkjet printing machine which performs color printing on a general-purpose paper 1 using a water-based ink.

Here, a general-purpose printing paper is not a so-called inkjet paper but is a paper that is mainly formed with cellulose such as a coated paper (an art paper, a coat paper, a light weight coat paper, a cast paper and a fine coating paper, and so on) used in offset printing, and so on. Moreover, the water-based ink is ink acquired by dissolving or dispersing a color material such as dyestuff or pigment in water or a water-soluble solvent.

As illustrated in FIG. 8, the inkjet recording apparatus 100 includes: a feeding portion 110 which feeds the paper 1; a processing liquid applying portion 120 which applies a predetermined processing liquid to the paper 1 fed from the feeding portion 110; a processing liquid drying portion 130 which performs drying processing on the paper 1 to which the processing liquid is applied; an image recording portion 140 which records an image on the paper 1 subjected to the drying processing in an inkjet method; an ink drying portion 150 which performs drying processing on the paper 1 on which the image is recorded; and an accumulating portion 160 which accumulates the paper 1 subjected to the drying processing.

[Feeding Portion]

The feeding portion 110 feeds papers 1 one by one. As illustrated in FIG. 8, the feeding portion 110 includes a feeding apparatus 112, a feeder board 114, a front plate 115 and a feeding drum 116.

The feeding apparatus 112 sequentially takes out the papers 1 set in a predetermined position in a paper bundle state one by one from the top and feeds them to the feeder board 114 one by one.

The feeder board 114 is formed according to the width of the paper 1 and is set up in which the front end side inclines to the lower side. The feeder board 114 slides the paper 1 fed from the feeding apparatus 112 along a conveyance surface and guides it to the front plate 115.

The front plate 115 is a plate-like member which is disposed so as to be orthogonal to the conveyance direction of the paper 1, is driven by a motor (not illustrated) and provided so as to be swingable. The front plate 115 swings and corrects the posture of the paper 1, and transfers the paper 1 whose posture is corrected to the feeding drum 116.

The feeding drum 116 receives the paper 1 from the front plate 115, conveys it along a predetermined conveyance path and transfers it to the processing liquid applying portion 120. The feeding drum 116 has a cylindrical shape, and, by gripping the end portion on the front side in the conveyance direction of the paper 1 by a gripper 117 provided in the peripheral surface and performing rotation, winds the paper 1 around the peripheral surface and conveys it.

[Processing Liquid Applying Portion]

The processing liquid applying portion 120 is a processing liquid applying device which applies a predetermined processing liquid to the image recording surface of the paper 1 while conveying the paper 1. The processing liquid applied in this processing liquid applying portion 120 is liquid having a function to condense, insolubilize or thicken color material elements in ink. Even if an image is recorded on a general-purpose printing paper in an inkjet method by applying such a processing liquid to the paper, the recording of a high-quality image becomes possible.

As illustrated in FIG. 8, the processing liquid applying portion 120 includes a processing liquid applying drum 122 which conveys the paper 1, and a processing liquid applying apparatus 124 which applies a processing liquid to the image recording surface of the paper 1 conveyed by the processing liquid applying drum 122.

The processing liquid applying drum 122 receives the paper 1 from the feeding drum 116 of the feeding portion 110, conveys the received paper 1 along a predetermined conveyance path and transfers it to the processing liquid drying portion 130. The processing liquid applying drum 122 has a cylindrical shape, and, by gripping the end portion on the front side in the conveyance direction of the paper 1 by a gripper 123 provided in the peripheral surface and performing rotation, winds the paper 1 around the peripheral surface and conveys it. The paper 1 is wound around the peripheral surface of the processing liquid applying drum 122 in a state in which the image recording surface is turned to the outside, and is conveyed.

The processing liquid applying apparatus 124 applies a processing liquid to the image recording surface of the paper 1. In the present embodiment, the processing liquid is applied by pressing a roller in which the processing liquid is applied to the peripheral surface (application roller) against the image recording surface of the paper 1 conveyed by the processing liquid applying drum 122. Here, the application method of the processing liquid is not limited to this, and it is possible to adopt an application method using an inkjet head and an application method using a spray, and so on.

The processing liquid applying portion 120 is configured as above. A processing liquid is applied to the image recording surface by the processing liquid applying apparatus 124 in a process in which the paper 1 is conveyed by the processing liquid applying drum 122.

[Processing Liquid Drying Portion]

The processing liquid drying portion 130 performs drying processing on the paper 1 while conveying the paper 1 to which a processing liquid is applied. The processing liquid drying portion 130 includes a processing liquid drying drum 132 which conveys the paper 1, and a processing liquid drying apparatus 134 which dries the paper 1 by blowing warm wind to the paper 1 conveyed by the processing liquid drying drum 132.

The processing liquid drying drum 132 receives the paper 1 from the processing liquid applying drum 122 of the processing liquid applying portion 120, conveys the received paper 1 along a predetermined conveyance path and transfers it to the image recording portion 140. The processing liquid drying drum 132 is configured with a frame body formed in a cylindrical shape and conveys the paper 1 by gripping the end portion on the front side in the conveyance direction of the paper 1 by a gripper 133 provided in the peripheral surface and performing rotation.

The processing liquid drying apparatus 134 is set up inside the processing liquid drying drum 132 and blows warm wind to the paper 1 conveyed by the processing liquid drying drum 132.

The processing liquid drying portion 130 is configured as above. Drying processing is performed by blowing warm wind to a processing liquid application surface by the processing liquid drying apparatus 134 in a process in which the paper 1 is conveyed by the processing liquid drying drum 132.

[Image Recording Portion]

The image recording portion 140 records a color image on the image recording surface of the paper 1 in an inkjet method by the use of inks of four colors of cyanogen, magenta, yellow and black while conveying the paper 1. As illustrated in FIG. 8, the image recording portion 140 includes: an image recording drum 141 which conveys the paper 1; a pressing roller 144 which presses the paper 1 conveyed by the image recording drum 141 against the peripheral surface of the image recording drum 141 and makes the paper 1 contact to the image recording drum 141; a head unit 145 which deposits the ink drop of each color of cyanogen, magenta, yellow and black to the paper 1 conveyed by the image recording drum 141 and records a color image on the paper 1; a scanner 147 which reads the image recorded on the paper 1; and the paper detecting sensor 32 which detects a bulge due to the float of the paper 1 or the crease of the paper 1.

The image recording drum 141 is one example of a conveying device. The image recording drum 141 receives the paper 1 from the processing liquid drying drum 132 of the processing liquid drying portion 130, conveys the received paper 1 along a predetermined conveyance path and transfers it to the ink drying portion 150. The image recording drum 141 has a cylindrical shape, and, by gripping the front end of the paper 1 by a gripper 143 provided in the peripheral surface and performing rotation, winds the paper 1 around the peripheral surface that is a paper holding surface and conveys it. As for the image recording drum 141, in the same way as the jetting cylinder 20 illustrated in FIG. 1, the endless belt 30 is stretched to a rotating shaft 142 and the rotating shaft 28 of the motor 26, and the driving force of the motor 26 is transmitted to the image recording drum 141 through the belt 30.

Moreover, the image recording drum 141 includes a suction mechanism to fix a currently conveyed paper 1 to the peripheral surface that is the paper holding surface. In the image recording drum 141 of the present embodiment, the paper 1 is sucked using a negative pressure. The image recording drum 141 has many suction holes in the peripheral surface, and, by performing suction from the inside of the drum through these suction holes, sucks and fixes the paper 1.

The pressing roller 144 presses the paper 1 conveyed by the image recording drum 141 against the peripheral surface of the image recording drum 141 and makes the paper 1 contact to the image recording drum 141. The pressing roller 144 is configured with a rubber roller having a width corresponding to the image recording drum 141. The pressing roller 144 is disposed immediately after a position in which the image recording drum 141 receives the paper 1 from the processing liquid drying drum 132. By this means, the paper 1 is wound around the peripheral surface of the image recording drum 141 while being pressed against the peripheral surface of the image recording drum 141 by the pressing roller 144.

The head unit 145 includes four inkjet heads 146C, 146M, 146Y and 146K.

The paper detecting sensor 32 is set up on the upstream side of the head unit 145 in the conveyance path of the paper 1 with the image recording drum 141. When the float or bulge of the paper 1 wound around the peripheral surface of the image recording drum 141 by the pressing roller 144 is detected, the motor 26 that drives the image recording drum 141 is stopped. By this means, the paper 1 in which abnormality occurs is prevented from colliding with the inkjet head 146C of the head unit 145 beforehand.

As illustrated in FIG. 8, the scanner 147 is set up on the downstream side of the head unit 145 in the conveyance path of the paper 1 with the image recording drum 141. The scanner 147 reads an image recorded on the paper 1 by the head unit 145.

The image recording portion 140 is configured as above. In a process in which the paper 1 conveyed by the image recording drum 141, the ink drop of each color of cyanogen, magenta, yellow and black is given to the image recording surface from each of the inkjet heads 146C, 146M, 146Y and 146K forming the head unit 145, and a color image is recorded on the image recording surface. The image recorded on the paper 1 is optionally read by the scanner 147.

[Ink Drying Portion]

The ink drying portion 150 performs drying processing while conveying the paper 1 immediately after image recording by the image recording portion 140. As illustrated in FIG. 8, the ink drying portion 150 includes: a chain gripper 152 which conveys the paper 1; a paper guide 154 which guides the running of the paper 1 conveyed by the chain gripper 152; and a heat drying apparatus 156 which heats and dries the image recording surface of the paper 1 conveyed by the chain gripper 152.

The chain gripper 152 receives the paper 1 from the image recording drum 141 of the image recording portion 140, conveys the received paper 1 along a predetermined conveyance path and ejects the paper to the accumulating portion 160. The chain gripper 152 includes a pair of sprockets 152A and an endless chain 152B which is wound around the pair of sprockets 152A and runs along a constant running path, and the vicinity of the front end of the paper 1 is gripped by a gripper 152C included in the chain 152B to convey the paper 1. By being conveyed to this chain gripper 152, the paper 1 passes through a heating region and a non-heating region which are set in the ink drying portion 150. Here, the heating region is set to a region in which the paper 1 conveyed from the image recording portion 140 is horizontally conveyed first, and the non-heating region is set to a region in which the paper 1 is conveyed while being inclined.

The paper guide 154 is disposed along the conveyance path of the paper 1 with the chain gripper 152 and guides the running of the paper 1 conveyed by the chain gripper 152. The paper guide 154 is configured including a first guideboard 154A and a second guideboard 154B.

The first guideboard 154A is a guideboard disposed in the heating region and has a hollow flat shape. In the first guideboard 154A, the upper surface portion is assumed as the guide surface of the paper 1, and the paper 1 is conveyed while sliding on this guide surface.

The guide surface of the first guideboard 154A includes a lot of suction holes (not illustrated). The first guideboard 154A guides the running of the paper 1 while attracting the paper 1 to the guide surface by sucking negative pressure from the inside through these suction holes.

Moreover, the first guideboard 154A includes a cooling mechanism (not illustrated) which cools the guide surface. The cooling mechanism is configured with, for example, a water-cooled cooling mechanism, and cools the guide surface by making a cooling liquid flow in an internally arranged channel. In the first guideboard 154A, the temperature of the guide surface is controlled to be a constant temperature by the use of this cooling mechanism.

The second guideboard 154B is a guideboard disposed in the non-heating region. The configuration of the second guideboard 154B is similar to the configuration of the first guideboard 154A. That is, it has a hollow flat shape and guides the running of the paper 1 while attracting the paper 1 to the guide surface by a suction hole (not illustrated). Moreover, it includes a cooling mechanism (not illustrated), and the temperature of the guide surface is controlled to a constant temperature.

The heat drying apparatus 156 is set up in the heating region, and heats and dries the image recording surface of the paper 1 conveyed in the heating region, by radiant heat from a heat source. The heat drying apparatus 156 includes a plurality of infrared lamps 156A as a heat source, and is disposed inside the chain gripper 152. The infrared lamps 156A are disposed at regular intervals along the conveyance path of the paper 1 in the heating region.

The ink drying portion 150 is configured as above. In a process in which the paper 1 is conveyed by the chain gripper 152, the image recording surface is heated by the heat drying apparatus 156 and is subjected to drying processing.

[Accumulating Portion]

The accumulating portion 160 accumulates sequentially rejected papers 1 in one place. As illustrated in FIG. 8, the accumulating portion 160 includes an accumulating apparatus 162 which receives and accumulates the papers 1 conveyed from the ink drying portion 150 by the chain gripper 152.

The chain gripper 152 cancels the gripping of the gripper 152C in a predetermined accumulation position and releases the papers 1. The accumulating apparatus 162 collects the released papers 1 and accumulates them in a bundle manner.

In the inkjet recording apparatus 100 according to the present embodiment, a conveying device which conveys the paper 1 along a conveyance path from the feeding apparatus 112 to the accumulating apparatus 162 is formed by the feeder board 114, the feeding drum 116, the processing liquid applying drum 122, the processing liquid drying drum 132, the image recording drum 141 and the chain gripper 152.

In the present embodiment, the paper detecting sensor 32 is set up on the upstream side of the head unit 145 in the conveyance path of the paper 1 by the image recording drum 141, and the collision between the paper 1 in which abnormality occurs and the head unit 145 is prevented by stopping the motor 26 which drives the image recording drum 141 when the paper detecting sensor 32 detects the float and bulge of the paper 1, but a position in which the paper detecting sensor 32 is set up is not limited to this position. For example, an aspect to prevent collision with the processing liquid applying apparatus 124 by setting up it on the upstream side of the processing liquid applying apparatus 124, an aspect to prevent collision with the scanner 147 (one example of a reading device) by setting up it on the upstream side of the scanner 147, and an aspect to prevent collision with the heat drying apparatus 156 (one example of a drying device) by setting up it on the upstream side of the heat drying apparatus 156 are possible. That is, as a processing device to be disposed in the conveyance path, it is possible to include at least one of the head unit 145, the processing liquid applying apparatus 124, the scanner 147 and the heat drying apparatus 156.

Here, as for the feeding drum 116, the processing liquid applying drum 122, the processing liquid drying drum 132, the image recording drum 141 and the pair of sprockets 152A of the chain gripper 152, cogwheels (gears) connected with respective rotating shafts are connected with each other and rotate in synchronization with the rotation of a motor (not illustrated) which drives the image recording drum 141. Therefore, when the belt 30 which transmits the driving force generated by the motor 26 to the image recording drum 141 degrades, a braking distance when the motor 26 stops becomes long. Therefore, by setting up the paper detecting sensor 32 on the upstream side in the conveyance direction of the processing liquid applying apparatus 124, the head unit 145, the scanner 147 and the heat drying apparatus 156, which are disposed in the conveyance path, and determining and reporting the degradation of the belt 30 on the basis of an abnormality detection signal of the paper detecting sensor 32 set up in each position, collision between the paper 1 and the processing liquid applying apparatus 124, the head unit 145, the scanner 147 or the heat drying apparatus 156 can be prevented beforehand.

The inkjet recording apparatus has been exemplified as a configuration example of the image recording apparatus in the present specification, but it can be widely applied to image recording apparatuses (for example, an image recording apparatus of an electrophotographic system) other than the inkjet recording apparatus.

The technical scope of the present invention is not limited to the range described in the above-mentioned embodiments. The configurations or the like in respective embodiments can be arbitrarily combined among respective embodiments without departing from the scope of the present invention.

What is claimed is:

1. A paper conveying apparatus comprising:

a driving device which rotates a driving rotating body by driving force generated by the driving device;

a conveying device which conveys a paper along a conveyance path according to rotation of a driven rotating body;

an endless drive transmission belt which is stretched to the driving rotating body and the driven rotating body;

a conveyance amount detecting device which detects a conveyance amount of the paper by the conveying device;

a processing device which is disposed in the conveyance path and applies processing to the paper;

an abnormality detecting device which is disposed on an upstream side from the processing device in the conveyance path and detects abnormality of the paper;

a stopping portion which stops the driving device when the abnormality detecting device detects the abnormality;

a calculating portion which calculates the conveyance amount of the paper in time before conveyance of the paper by the conveying device stops after the abnormality is detected;

a degradation detecting portion which compares the calculated conveyance amount and a threshold and determines that the drive transmission belt is degraded if the calculated conveyance amount is larger than the threshold; and a reporting portion which reports a determination result of the degradation detecting portion.

2. The paper conveying apparatus according to claim 1, wherein:

the conveying device is a cylinder which holds the paper to a peripheral surface; and the driven rotating body is coupled with a shaft of the cylinder.

3. The paper conveying apparatus according to claim 1, wherein:

the conveying device includes a conveyance belt which holds the paper to a surface; and the driven rotating body is a roller to which the conveyance belt is stretched.

4. The paper conveying apparatus according to claim 1, wherein the conveyance amount detecting device is a rotary encoder which outputs a pulse signal every unit rotation angle of the driven rotating body.

5. The paper conveying apparatus according to claim 1, wherein:

the threshold includes a first threshold and a second threshold smaller than a value of the first threshold; and the degradation detecting portion determines degradation of the drive transmission belt in two stages.

6. The paper conveying apparatus according to claim 5, wherein the reporting portion reports that exchange of the drive transmission belt is necessary if the degradation detecting portion determines that the calculated conveyance amount is larger than the first threshold, and the reporting portion reports that adjustment of the drive transmission belt is necessary if the degradation detecting portion determines that the calculated conveyance amount is equal to or smaller than the first threshold and larger than the second threshold.

7. The paper conveying apparatus according to claim 1, wherein the abnormality detecting device includes at least one of a float sensor, an overlap feed sensor and a jam sensor.

8. The paper conveying apparatus according to claim 1, further comprising a self-diagnosing portion which operates the abnormality detecting device in a pseudo or compulsive manner.

9. The paper conveying apparatus according to claim 1, further comprising an inactivating portion which inactivates the calculating portion and the degradation detecting portion.

10. The paper conveying apparatus according to claim 1, wherein the processing device includes at least one of a processing liquid applying device which applies a processing liquid to the paper, an image forming device which deposits droplets to the paper and forms an image, a reading device which reads the paper, a varnish applying device which applies varnish to the paper and a drying device which dries the paper.

11. A paper conveying method comprising:

a driving step of rotating a driving rotating body by driving force generated by a driving device;

a transmitting step of transmitting the driving force from the driving rotating body to a driven rotating body by an endless drive transmission belt stretched to the driving rotating body and the driven rotating body of a conveying device;

a conveying step of conveying a paper along a conveyance path of the conveying device according to rotation of the driven rotating body;

a conveyance amount detecting step of detecting, by a conveyance amount detecting device, a conveyance amount of the paper in the conveying step;

a processing step of applying processing to the paper by a processing device disposed in the conveyance path;

an abnormality detecting step of detecting abnormality of the paper by an abnormality detecting device disposed on an upstream side from the processing device in the conveyance path;

a stopping step of stopping the driving device by a stopping portion when the abnormality is detected in the abnormality detecting step;

a calculating step of calculating, by a calculating portion, the conveyance amount of the paper in time before conveyance of the paper in the conveying step stops after the abnormality is detected;

a degradation detecting step of comparing the calculated conveyance amount and a threshold by a degradation detecting portion and determining by the degradation detecting portion that the drive transmission belt is degraded if the calculated conveyance amount is larger than the threshold; and a reporting step of reporting, by a reporting portion, a determination result of the degradation detecting step.

12. A non-transitory tangible computer-readable recording medium including a program stored thereon, such that when the program is read and executed by a computer, the computer is configured to perform:

a driving step of rotating a driving rotating body by driving force generated by a driving device;

a transmitting step of transmitting the driving force from the driving rotating body to a driven rotating body by an endless drive transmission belt stretched to the driving rotating body and the driven rotating body of a conveying device;

a conveying step of conveying a paper along a conveyance path of the conveying device according to rotation of the driven rotating body;

a conveyance amount detecting step of detecting, by a conveyance amount detecting device, a conveyance amount of the paper in the conveying step;

a processing step of applying processing to the paper by a processing device disposed in the conveyance path;

an abnormality detecting step of detecting abnormality of the paper by an abnormality detecting device disposed on an upstream side from the processing device in the conveyance path;

a stopping step of stopping the driving device by a stopping portion when the abnormality is detected in the abnormality detecting step;

a calculating step of calculating, by a calculating portion, the conveyance amount of the paper in time before conveyance of the paper in the conveying step stops after the abnormality is detected;

a degradation detecting step of comparing the calculated conveyance amount and a threshold by a degradation detecting portion and determining by the degradation detecting portion that the drive transmission belt is degraded if the calculated conveyance amount is larger than the threshold; and a reporting step of reporting, by a reporting portion, a determination result of the degradation detecting step.

* * * * *